US009134089B2

(12) United States Patent
Yang

(10) Patent No.: US 9,134,089 B2
(45) Date of Patent: Sep. 15, 2015

(54) AIRSOFT GUNS STRUCTURE WITH IMPROVED REALITY AND SAFETY GASIFICATION SYSTEM FOR THE COMPRESSED GAS CARTRIDGE

(75) Inventor: Tsung-Yun Yang, Taipei (TW)

(73) Assignees: Yen-Ting Liao, Taipei (TW); Tsung-Yun Yang, Taipei (TW)

( * ) Notice: Subject to any disclaimer, the term of this patent is extended or adjusted under 35 U.S.C. 154(b) by 72 days.

(21) Appl. No.: 13/989,886

(22) PCT Filed: Nov. 10, 2011

(86) PCT No.: PCT/CN2011/082008

§ 371 (c)(1),
(2), (4) Date: May 28, 2013

(87) PCT Pub. No.: WO2012/071973

PCT Pub. Date: Jun. 7, 2012

(65) Prior Publication Data

US 2013/0247893 A1 Sep. 26, 2013

(30) Foreign Application Priority Data

Nov. 30, 2010 (CN) ..... 2010 1 0572095

(51) Int. Cl.

| | |
|---|---|
| ***F41B 11/00*** | (2013.01) |
| ***F41B 11/55*** | (2013.01) |
| ***F41B 11/89*** | (2013.01) |
| ***F41B 11/50*** | (2013.01) |
| ***F41B 11/62*** | (2013.01) |
| ***F41B 11/721*** | (2013.01) |
| ***F41A 21/16*** | (2006.01) |

(52) U.S. Cl.

CPC ..... *F41B 11/00* (2013.01); *F41A 21/16* (2013.01); *F41B 11/50* (2013.01); *F41B 11/55* (2013.01); *F41B 11/62* (2013.01); *F41B 11/721* (2013.01); *F41B 11/89* (2013.01)

(58) Field of Classification Search

USPC ..... 124/73–76, 56; 434/18

See application file for complete search history.

(56) References Cited

U.S. PATENT DOCUMENTS

| | | | | |
|---|---|---|---|---|
| 4,079,525 | A * | 3/1978 | Linton et al. | 434/18 |
| 4,480,999 | A * | 11/1984 | Witherell et al. | 434/18 |
| 4,725,235 | A * | 2/1988 | Schroeder et al. | 434/18 |
| 4,955,812 | A * | 9/1990 | Hill | 434/16 |
| 5,244,431 | A * | 9/1993 | D'Andrade | 446/406 |
| 5,569,085 | A * | 10/1996 | Igarashi et al. | 463/49 |
| 5,857,854 | A * | 1/1999 | Kwalwasser | 434/18 |
| 5,947,738 | A * | 9/1999 | Muehle et al. | 434/16 |
| 6,682,350 | B2 * | 1/2004 | Kehl et al. | 434/18 |
| 7,033,175 | B2 * | 4/2006 | Kunimoto | 434/18 |
| 7,730,881 | B1 * | 6/2010 | Pedicini et al. | 124/65 |
| 7,806,113 | B2 * | 10/2010 | Skilling | 124/73 |
| 8,360,042 | B2 * | 1/2013 | Skilling | 124/71 |

(Continued)

*Primary Examiner* — Michael David

(57) ABSTRACT

An airsoft gun structure redesigns the conventional high-pressure toy gun to shunt high-pressure air flow during shooting. Therefore, the shunted high-pressure air flow simulates recoils as real bolt-action, single-shot rifles. Also, the ammunition supply includes different cartridges to select one of the supply-type by the users and whether shell case ejection or not. When the airsoft gun is operated, the realistic action is achieved to enhance the fun of shooting. Furthermore, the dual hop up system makes the flight path of bullets more stable without shift. Moreover, the safety gasification system could make the supplied amount of the output compressed high pressure air be almost constant to enhance security during operation.

3 Claims, 12 Drawing Sheets

(56) References Cited

U.S. PATENT DOCUMENTS

| | | | | |
|---|---|---|---|---|
| 8,578,922 | B1 * | 11/2013 | Granger | 124/74 |
| 2004/0137411 | A1 * | 7/2004 | Kemp et al. | 434/11 |
| 2005/0000505 | A1 * | 1/2005 | Pedicini et al. | 124/63 |
| 2005/0074726 | A1 * | 4/2005 | Metcalfe et al. | 434/18 |
| 2005/0260545 | A1 * | 11/2005 | Schavone | 434/18 |
| 2009/0277436 | A1 * | 11/2009 | Wei | 124/74 |
| 2010/0227298 | A1 * | 9/2010 | Charles | 434/18 |
| 2011/0017187 | A1 * | 1/2011 | Brock | 124/71 |
| 2011/0271940 | A1 * | 11/2011 | Meggs et al. | 124/56 |
| 2011/0271941 | A1 * | 11/2011 | Meggs | 124/65 |
| 2011/0287388 | A1 * | 11/2011 | Hu | 434/18 |
| 2011/0318715 | A1 * | 12/2011 | Markert et al. | 434/18 |
| 2012/0129136 | A1 * | 5/2012 | Dvorak | 434/18 |
| 2013/0291848 | A1 * | 11/2013 | Wood | 124/73 |
| 2014/0065577 | A1 * | 3/2014 | Quinlan et al. | 434/18 |

* cited by examiner

AIRSOFT GUNS STRUCTURE WITH IMPROVED REALITY AND SAFETY GASIFICATION SYSTEM FOR THE COMPRESSED GAS CARTRIDGE

BACKGROUND OF THE INVENTION

1. Field of Invention

The present invention relates to an airsoft gun, more particularly to the airsoft gun with improved reality.

2. Related Art

A survival game has already been a leisure activity which people are often taking People can use toy guns in hands to emulate a real field combat situation and can play team games with others to develop a tacit understanding of the games and to obtain an entertainment effect. The toy gun usually uses air as its power source to achieve a shooting effect by air to drive the bullets in a frame and the power source can keep providing to the toy gun using only a gas cylinder in the clip, when shooting.

There is significant commercial demand for toys that can fire hard plastic BB projectiles. A category of such toys are known in the art as so-called "airsoft" guns. Although the BB projectiles comprise hard plastic, they are less dangerous than metal BB projectiles because they are less massive and therefore carry less momentum at a given velocity. Hence, airsoft players often fire airsoft guns at other players during airsoft games and competitions, without significant injury (so long as eyes are well protected).

Furthermore, a current virtual-reality field shooting exercise has been one of the popular recreation activities, wherein players are pursuing a feeling as if shooting with a real gun, thereby enabling a pulling of a trigger to become one of the indispensable factors.

Accordingly, how to solve the aforementioned problems is a technical issue to be resolved by the inventor of present invention.

SUMMARY OF THE INVENTION

It is an objective of this invention to provide an airsoft gun with a gas shunting system. The gas shunting system divides a compressed high pressure air to drive out a projectile and guide to move a hammer block to generate impact for simulating recoil motion after shooting.

Another objective of this invention is to provide an airsoft gun with a dual hop up system to make the flight path be more stable and to enhance the flight range and accuracy.

It is an objective of this invention to provide an airsoft gun with a refilling system. The refilling system includes a dual magazine assembly for housing two different cartridges. The first magazine is capable of housing ball bullets and the second magazine is capable of housing ball bullets with shell cases.

It is an objective of this invention to provide an airsoft gun with a gasification system could make the supplied amount of the output compressed high pressure air be almost constant to enhance security during operation.

In order to implement the abovementioned, this invention discloses an airsoft gun with a dual hop up (DHU) system, a recoil motion system, a gasification system, a refilling system, and a gas shunting system. The airsoft gun further comprises an inner barrel and an outer barrel. The outer barrel has an air inlet and an air outlet, a back block, a front block and the hammer block are disposed between the inner barrel and the outer barrel. A hammer block spring is attached to an inner surface of the back block in the inner barrel. At the end of the hammer block spring on the opposite side to the back block, the hammer block is attached. The compressed high pressure air are guided from the air inlet to move the hammer block. The compressed high pressure air is released from the air outlet when the hammer block punches the back block. The hammer block spring pushes the hammer block back to punch the front block to generate impact for simulating recoil motion.

The dual hop up system includes a first boss portion, located at the inner surface of the inner barrel near to a bore of the airsoft gun to make a projectile rotate to increase its range of flight, and a second boss portion, located at the inner surface of the inner barrel and adjacent to the first boss portion to correct a rotating axis of the projectile to make the flight path be more stable.

The gasification system includes a compressed gas cartridge and a vaporization tube. One end of the vaporization tube is exposed to the compressed gas cartridge and the other end is extended into the compressed gas cartridge near to a substantial center therein to make the supplied amount of output compressed high pressure air be constant. The distance between the end of the vaporization tube and a liquid air inside the compressed gas cartridge is the same to make a pressure of a gaseous air be constant to enhance security during operation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

The purpose, construction, features, and functions of the invention can be appreciated and understood more thoroughly through the following detailed description with reference to the attached drawings.

Figure 1:
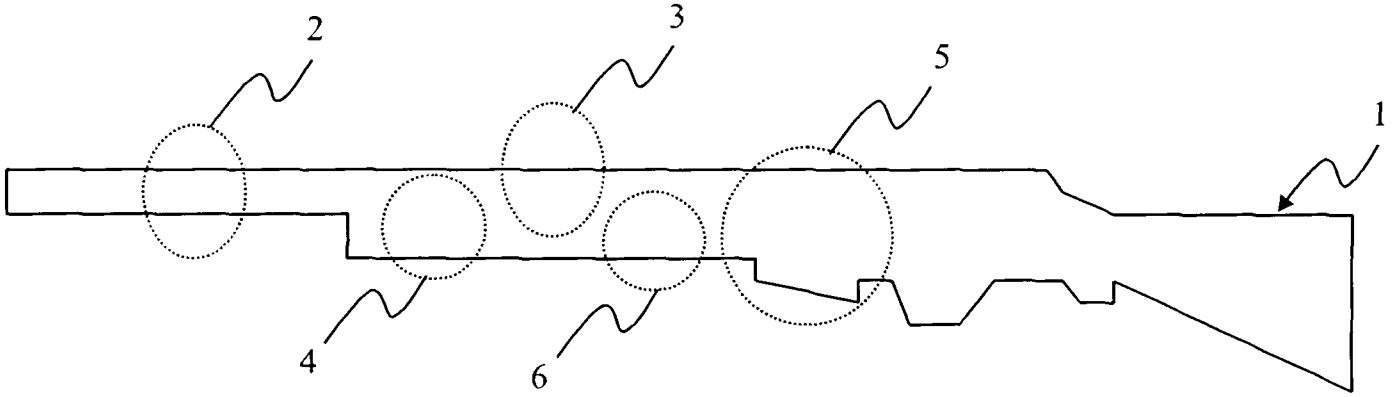
FIG. 1 is respective view of the airsoft gun in accordance with the present invention.

Please refer to FIG. 1, the airsoft gun of the present invention includes a gun body 1 with a dual hop up (DHU) system 2, a recoil motion system 3, a gasification system 4, a refilling system 5, and a gas shunting system 6.

Please see FIGS. 2A-2E, the refilling system 5 of the present invention includes a dual magazine assembly 50 for housing two different cartridges. The first magazine 50*a* is capable of housing ball bullets 90 and the second magazine 50*b* is capable of housing ball bullets 90 with shell cases 60.

Figure 2A:
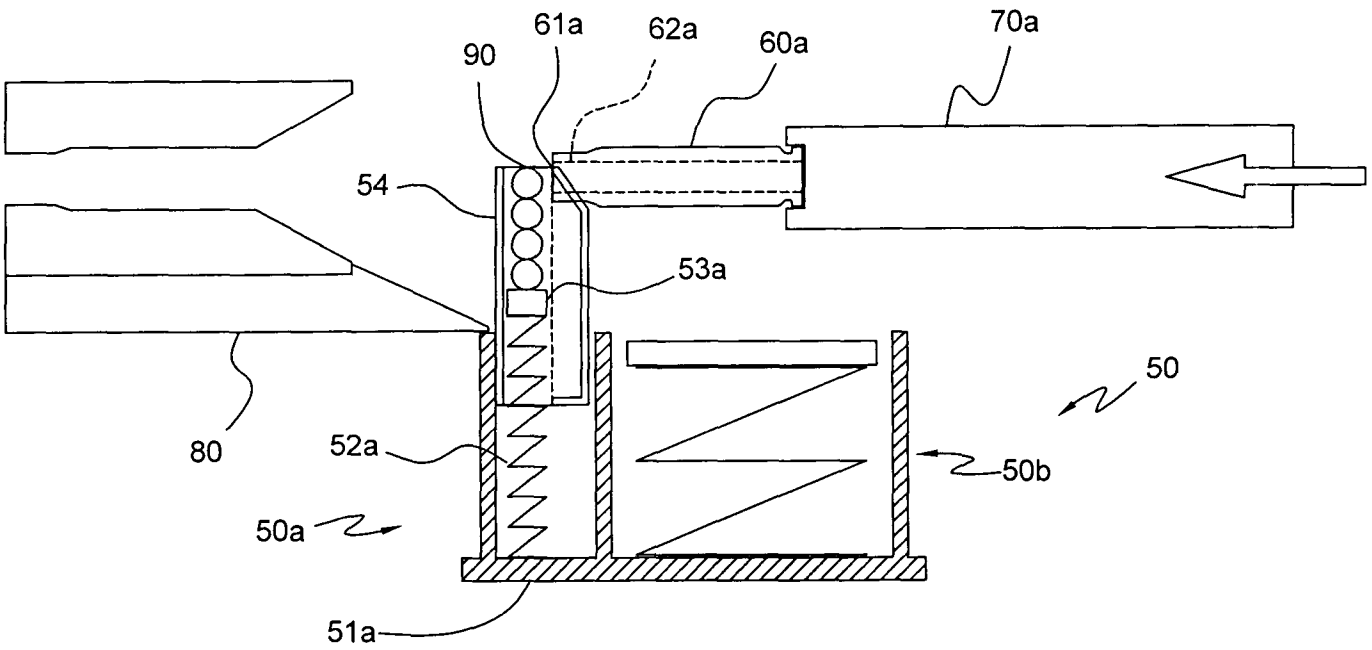
FIGS. 2A-2B are respective views of the refilling system in accordance with the present invention when the first magazine is utilized.
Figure 2B:
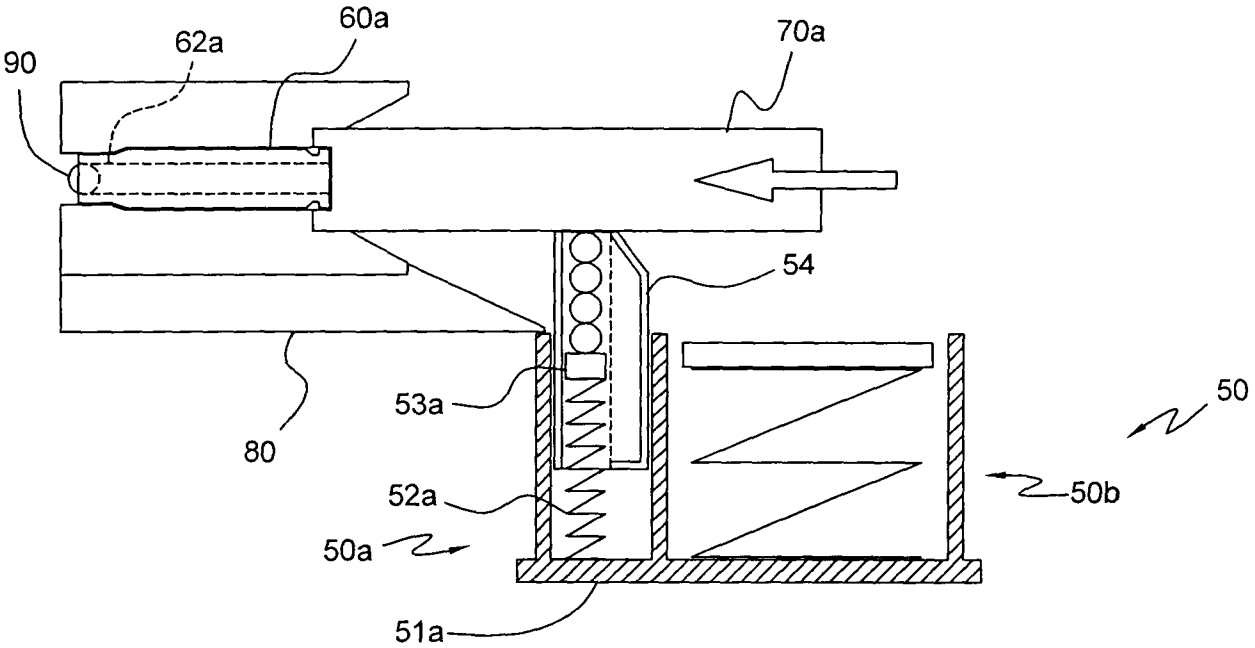

Please refer to FIGS. 2A-2B, which are respective views of the refilling system in accordance with the present invention when the first magazine is utilized.

The first magazine 50*a* is a hollow member with one end being a closed end 51*a* and is capable of housing ball bullets 90 therein. A magazine spring 52*a* is attached to the inner surface of the closed end 51*a* in the first magazine 50*a*. At the end of the magazine spring 52*a* on the opposite side to the closed end 51*a*, a magazine follower 53*a* that pushes ball bullets 90 is attached. The first magazine 50*a* includes a hollow slider 54 to hold the ball bullets 90. The Ball bullets 90 are guided away from the first magazine 50*a* through an opening provided by the slider 54.

The first action 70*a* includes a shell case front end 60*a*. The shell case front end 60*a* has a through hole 62*a* with an opening 61*a*. When the first action 70*a* is pushed, the first one ball bullet 90, which is slightly outside of the slider 54, would be mounted on the opening 61*a* of the shell case front end 60*a* of the first action 70*a*. The slider 54 is pushed downward to the first magazine 50*a* along to the sidewall of the first action 70*a*. Then, the ball bullet 90 is pushed into the bore 80 to refill.

After shooting, the ball bullet 90 is shot and the first action 70*a*, including the shell case front end 60*a*, is pulled back to leave away from the bore 80. The slider 54 would move upward along to the sidewall of the first magazine 50*a*. And one of the ball bullets 90 inside the first magazine 50*a* is pushed to be slightly outside of the top end of the slider 54, as shown in FIG. 2A. Therefore, even the bullets are ball bullets 90, such as BB bullets, steel balls or paintballs, the airsoft gun could simulate refilling action as real bolt-action, single-shot rifles to increase the reality.

Figure 2C:
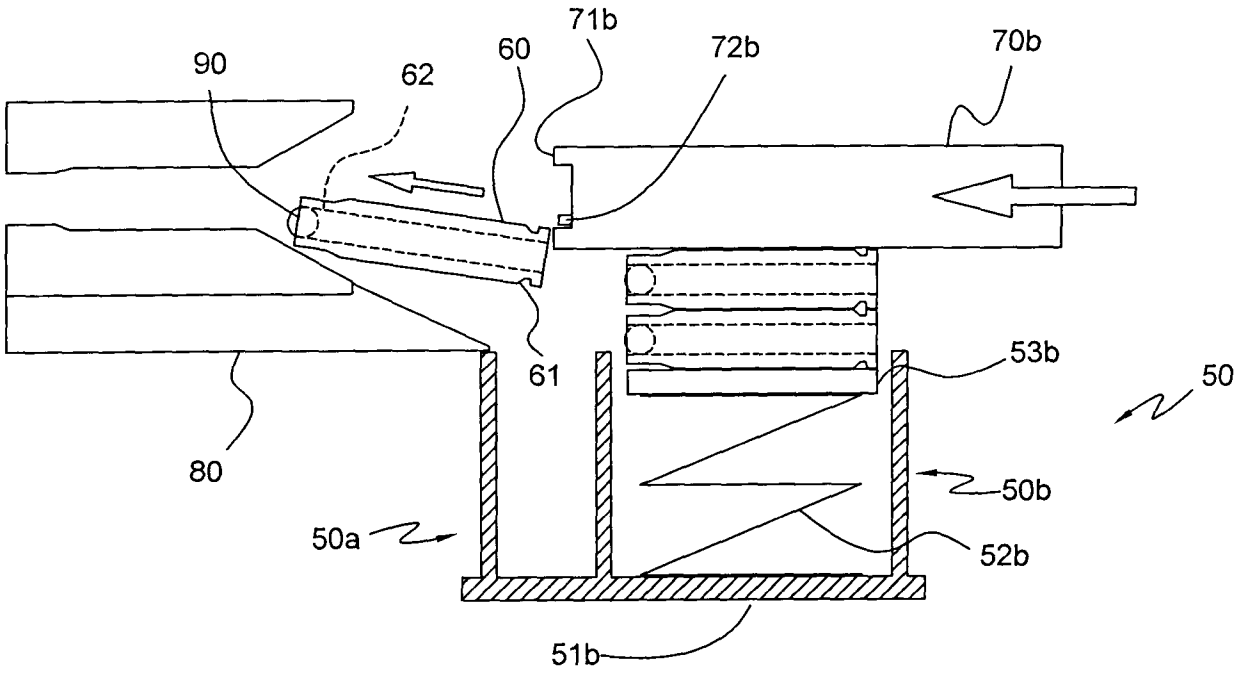
FIGS. 2C-2E are respective views of the refilling system in accordance with the present invention when the second magazine is utilized.
Figure 2D:
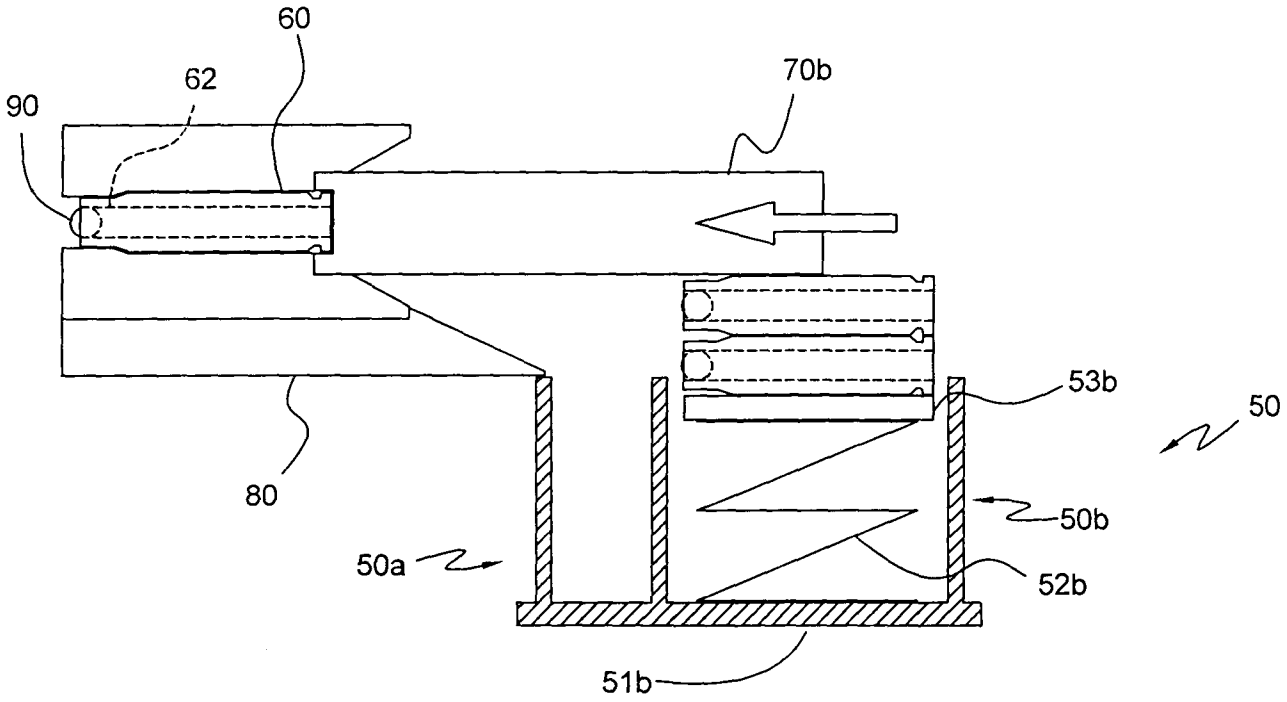
Figure 2E:
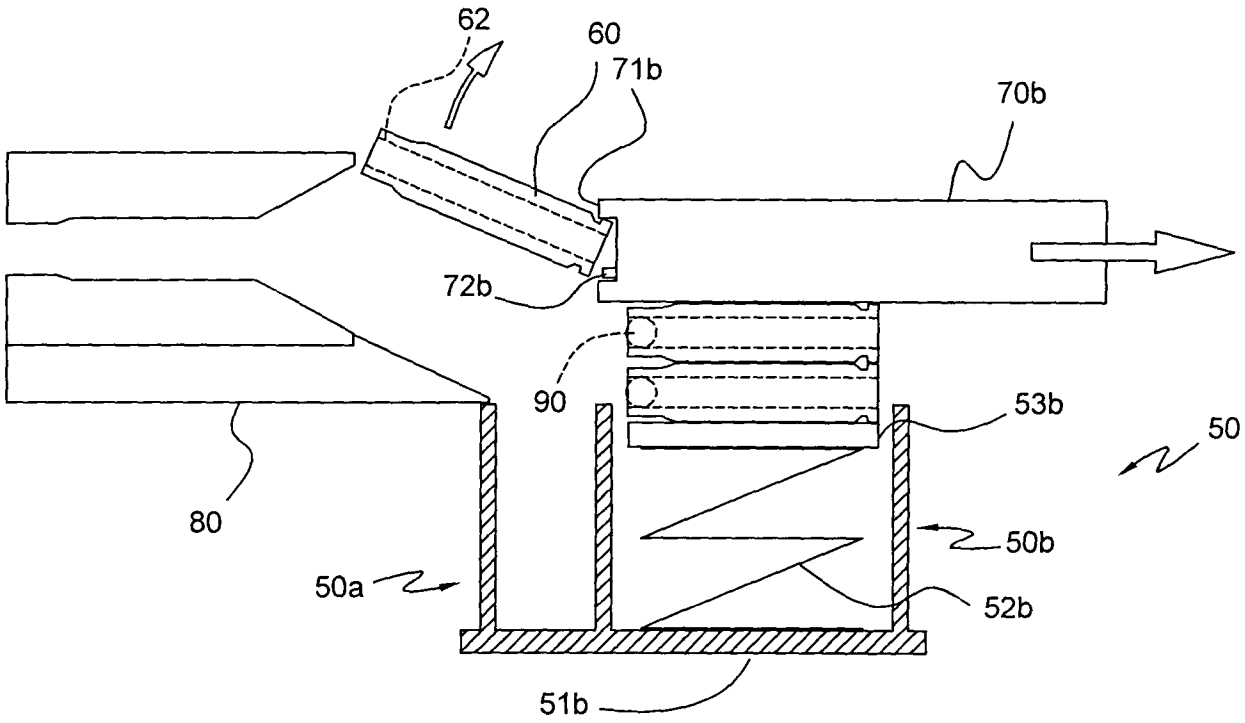

Please refer to FIGS. 2C-2E, which are respective views of the refilling system in accordance with the present invention when the second magazine is utilized.

In this embodiment, a second magazine 50*b* is located adjacent to the first magazine 50*a*. The second magazine 50*b* is also a hollow member with one end being a closed end 51*b* and is capable of housing ball bullets 90 with shell cases 60 therein. A magazine spring 52*b* is attached to the inner surface of the closed end 51*b* in the second magazine 50*b*. At the end of the magazine spring 52*b* on the opposite side to the closed end 51*b*, a magazine follower 53*b* that pushes ball bullets 90 with shell cases 60 is attached. The Ball bullets 90 with shell cases 60 are guided away from the second magazine 50*b* through an top opening thereof.

The second action 70*b* includes a jaw 71*b* and a case ejector 72*b* at the front end. When the second action 70*b* is pushed, the first one ball bullet 90 with shell case 60 would be pushed toward into the bore 80. And the bullet groove 61 is clipped by the jaw 71*b* to refill. And the shell case 60 has a through hole 62.

After shooting, the ball bullet 90 is shot and the second action 70*b* together with the shell case 60 are pulled back to leave away from the bore 80. The shell case 60 is ejected by the case ejector 72*b*. Therefore, in this embodiment, the airsoft gun could simulate refilling and ejecting actions as real bolt-action, single-shot rifles to increase the reality.

Moreover, the refilling system 5 of the present invention includes a dual magazine assembly 50 for housing two different cartridges. Each cartridge is utilized a different action, the first action 70*a* and the section action 70*b*. The users can change actions depends on which cartridge is utilized.

Figure 3B:
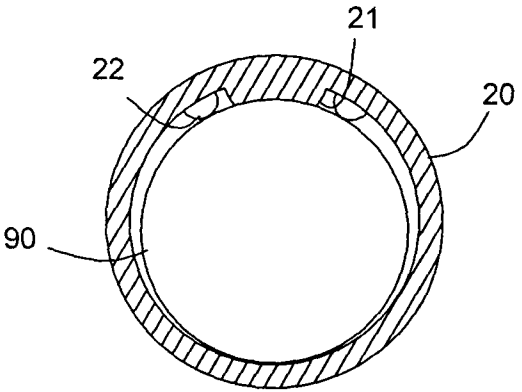
FIGS. 3A-3B are sectional views of the dual hop up (DHU) system in accordance with the present invention.
Figure 3A:
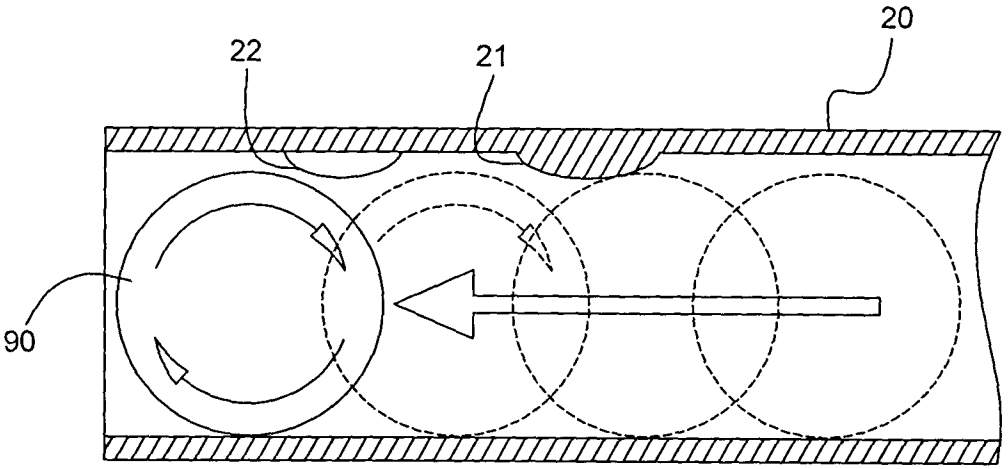

Please refer to FIGS. 3A-3B, which are sectional views of the dual hop up (DHU) system in accordance with the present invention.

The dual hop up (DHU) system 2 includes a first boss portion 21 and a second boss portion 22 at an inner surface of the inner barrel 20. The first boss portion 21 is located at the inner surface of the inner barrel 20 near to the bore 80, i.e. the right side in FIG. 3A. When the ball bullet 90 enters into the inner barrel 20, the friction occurred between the first boss portion 21 and the ball bullet 90 would make the ball bullet 90 rotate to increase its range of flight. As shown in FIG. 3A, the ball bullet 90 would rotate counter-clockwise. The second boss portion 22 is located at the inner surface of the inner barrel 20 and adjacent to the first boss portion 21. The function of the second boss portion 22 is different from the function of the first boss portion 21. When the ball bullet 90 enters into the inner barrel 20, the initial velocity is very high. During friction of the first boss portion 21, the friction point may not be the center point of the ball bullet 90 to cause the rotating axis of the ball bullet 90 to be shift. The flight path would be unstable. Therefore, by the second boss portion 22, the rotating axis of the ball bullet 90 is corrected to make the flight path be more stable, especially is horizontal flight path.

Please refer to FIG. 3B, the first boss portion 21 includes a single protrusion to make the ball bullet 90 rotate. And the second boss portion 22 includes a plurality of protrusions. As shown in FIG. 3B, the second boss portion 22 includes two protrusions to make the ball bullet 90 rotate and fly more stable. The material of the protrusions is elastics material, such as rubber. The height of the protrusions may be adjustable to modify the friction between the protrusions and the ball bullet 90 to enhance the flight range and accuracy.

Please refer to FIGS. 4A-4D, which are sectional views of the simulating recoil motion in accordance with the present invention.

When the airsoft gun is triggered, a delay mechanism is enabled. The delay mechanism includes an air valve 30, a pin 31, a collapsing spring 32, a relief lever 33 and a valve spring 35. The air valve 30 is opened when the airsoft gun is triggered, and the pin 31 is moved down to be against the air valve 30 to keep the air valve 30 opening. The compressed high pressure air are shunted by the gas shunting system 6. The gas shunting system 6 is integrated with the gun body 1 of the airsoft gun. The compressed high pressure air are divided to drive out the ball bullets 90 and guide to the air inlet 11.

The outer barrel 10 has the air inlet 11 and the air outlet 12. A back block 23, a front block 29 and a hammer block 24 are disposed between the inner barrel 20 and the outer barrel 10. The hammer block 24 is a sleeve member to be put on the inner barrel 20. A hammer block spring 25 is attached to the inner surface of the back block 23 in the outer barrel 10. At the end of the hammer block spring 25 on the opposite side to the back block 23, the hammer block 24 is attached. An outer ring 26 and an inner ring 27 are disposed to the hammer block 24 to make contact with the inner surface of the outer barrel 10 and the outer surface of the inner barrel 20 respectively. A chamber 28 within the outer barrel 10 is formed by the front block 23, the outer ring 26 and the inner ring 27. The hammer block 24 is moveable along the inner barrel 20 between the front block 29 and the back block 23. When the compressed high pressure air are guided into the chamber 28 from the air inlet 11, the hammer block 24 is pushed to slide along the inner barrel 20. The hammer block spring 25 is pressed and the gun body 1 is moved forward slightly due to the reacting force.

When the hammer block 24 slides toward the back block 23 and pushes a collapsing slider 321 of the collapsing spring 32, the collapsing slider 321 would be moved downward along to the inclined plane 322 of the collapsing spring 32. The collapsing spring 32 is moved backward to push the relief lever 33 to lift the pin 31. When the pin 31 is lifted, the air valve 30 is released by the valve spring 35 to be closed. The compressed high pressure air is stopped to be supplied. By the inclined plane 322 of the collapsing spring 32, the hammer block 24 slides to push the collapsing slider 321 of the collapsing spring 32 without crash the delay mechanism. Furthermore, by the delay mechanism, the compressed high pressure air are still supplied to push the hammer block 24 after the ball bullets 90 are driven out.

Figure 4A:
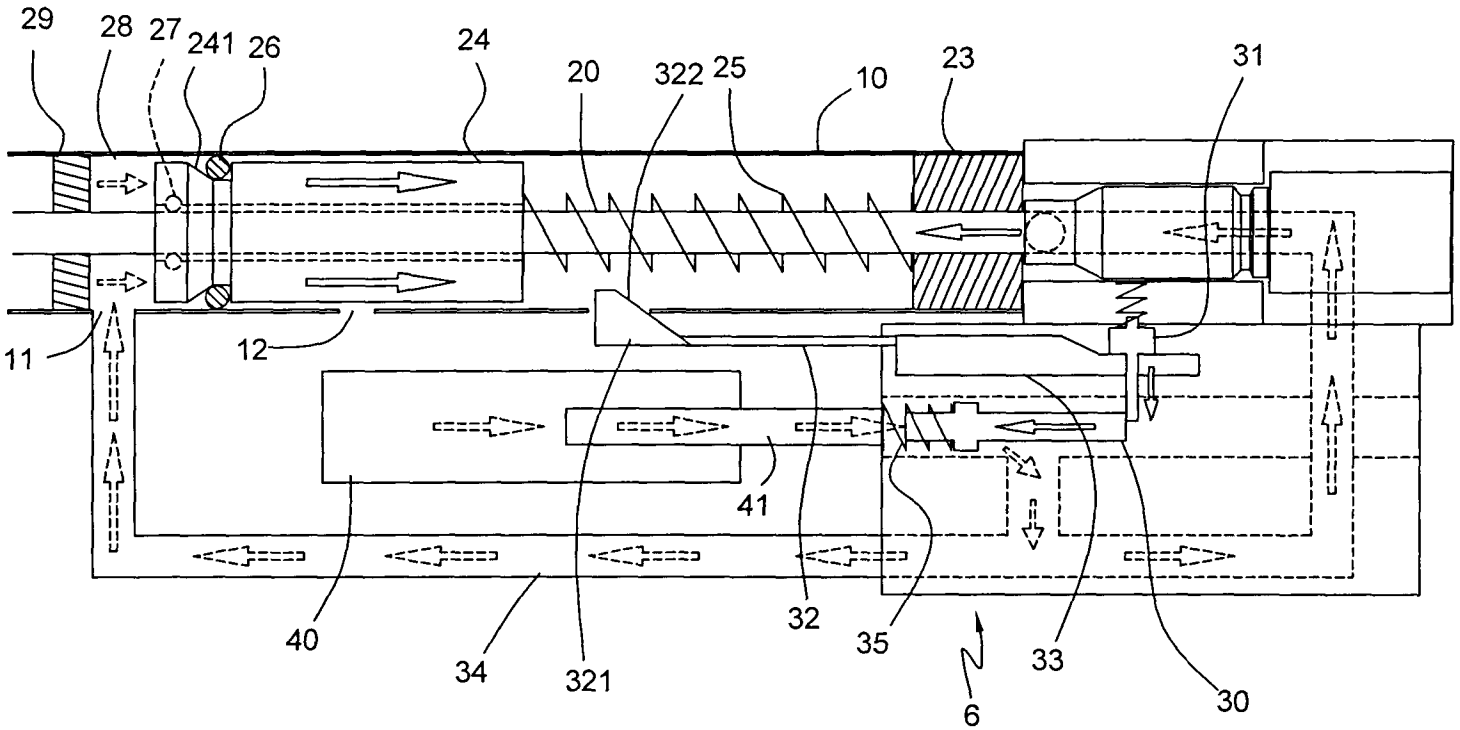
FIGS. 4A-4D are sectional views of the simulating recoil motion in accordance with the present invention.
Figure 4B:
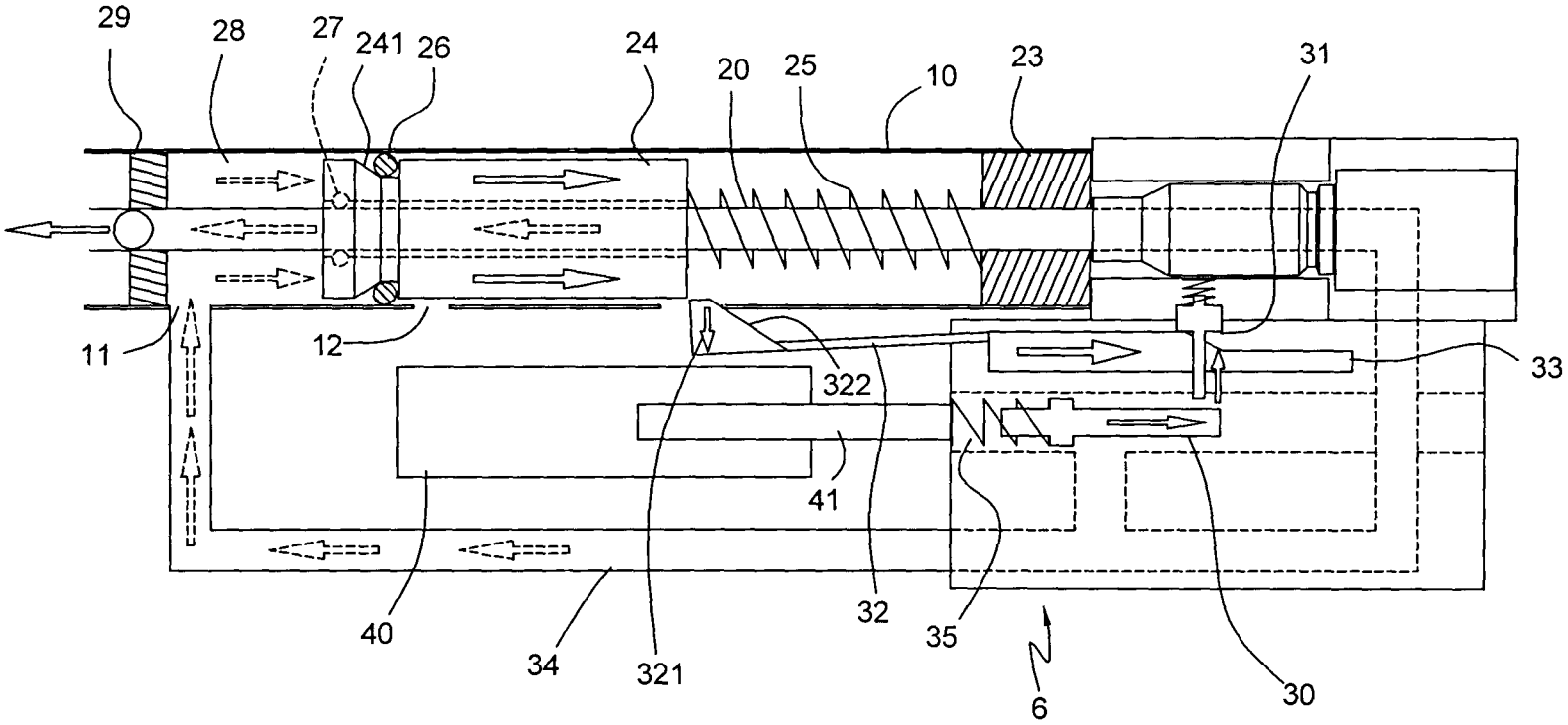
Figure 4C:
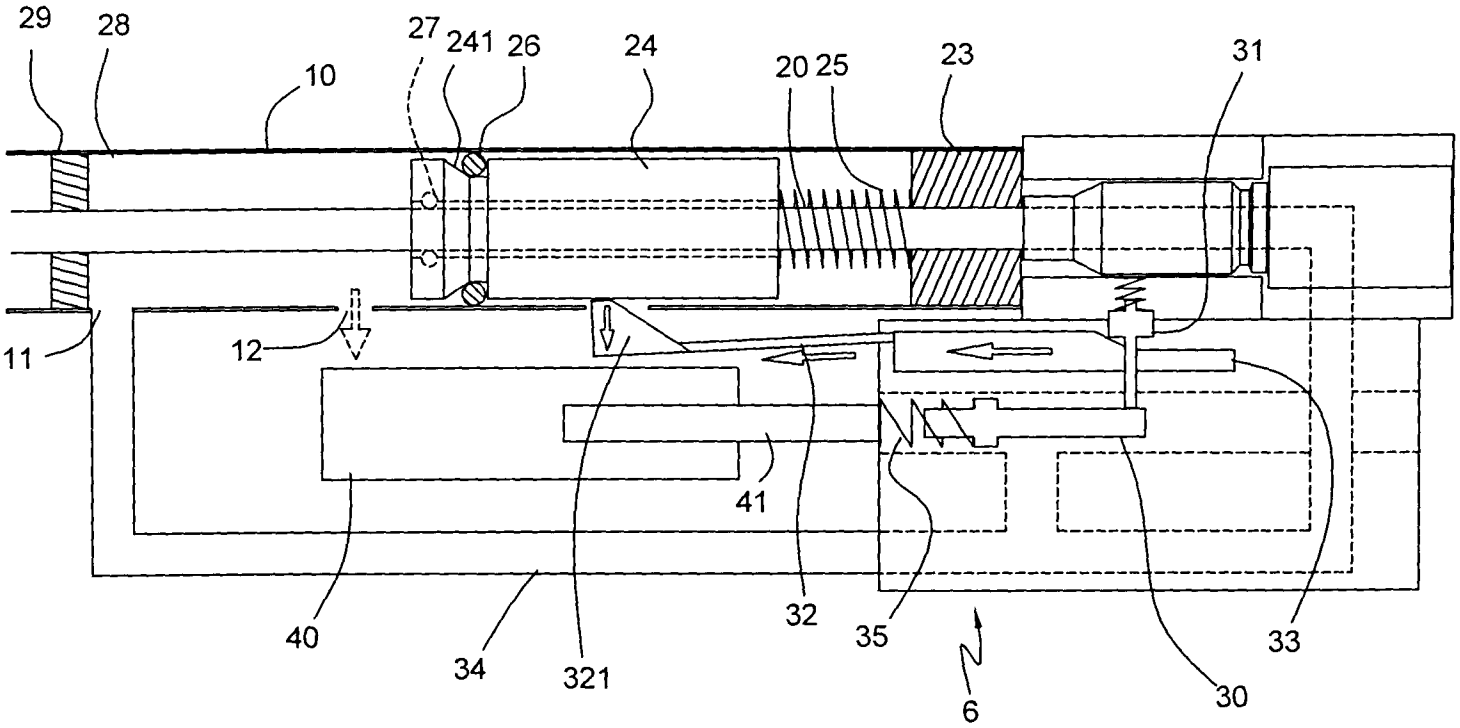
Figure 4D:
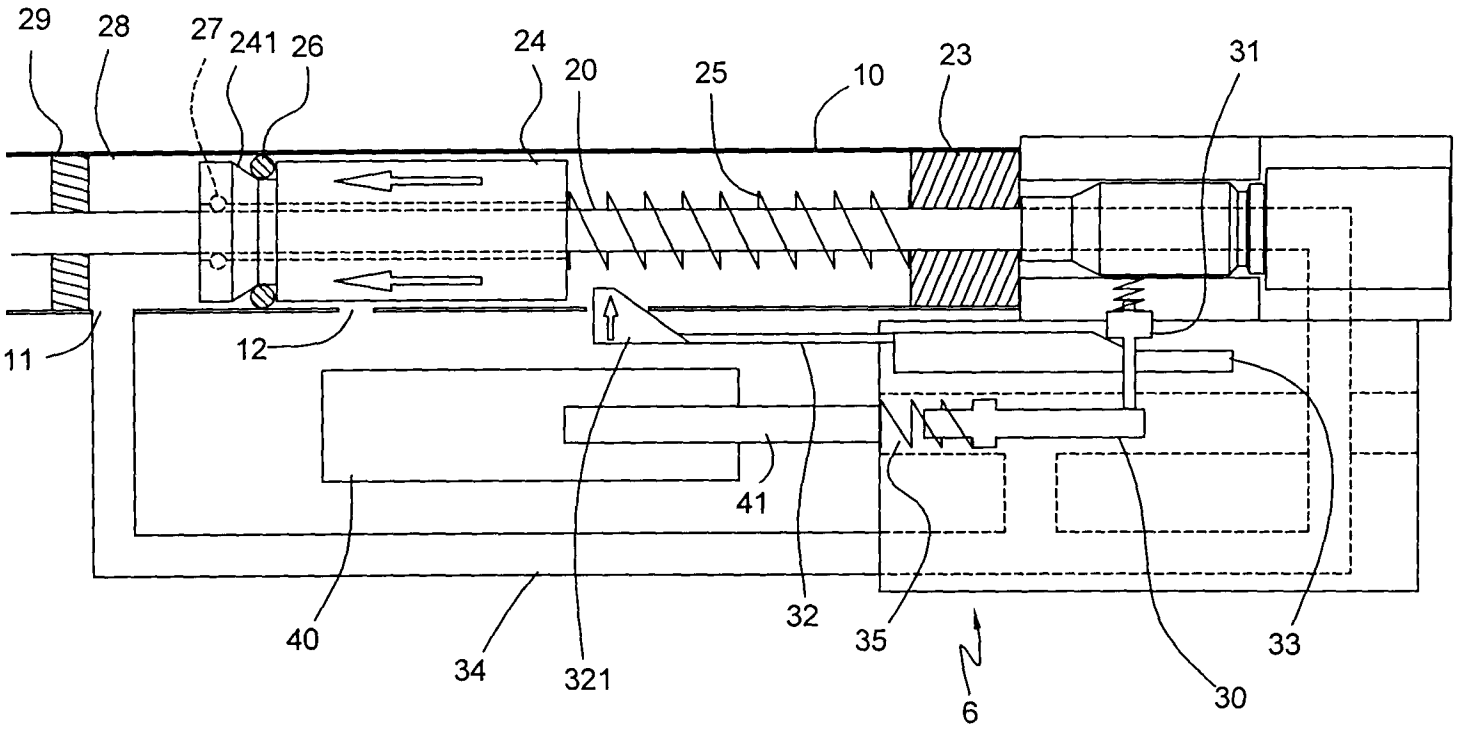

After the delay mechanism is released, the hammer block 24 still slides to punch the back block 23 to generate impact. The compressed high pressure air within the chamber 28 is released by the air outlet 12, as shown in FIG. 4C. After the compressed high pressure air within the chamber 28 is released, the hammer block spring 25 pushes the hammer block 24 back due to the spring force of compression. The gun body 1 is moved backward slightly due to the reacting force. The hammer block 24 still slides to punch the front block 29 to generate impact. Therefore, by those impact and the reacting force, the airsoft gun could simulate recoil motion after shooting as a real gun to increase the reality.

The hammer block 24 includes an inclined groove 241 at the outer surface and the outer ring 26 is disposed therein. During the hammer block 24 slides toward the back block 23, the outer ring 26 is moved along the inclined groove 241 to increase airtight performance. The transformation caused by temperature of the outer ring 26 to decrease airtight performance would be overcome. And the recoil motion performance is also improved.

Please refer to FIGS. 5A-5D, which are respective views of the gasification system in accordance with the present invention.

The airsoft gun is powered by a compressed gas cartridge 40. The compressed gas cartridge 40 contains liquid air 42. The liquid air 42 tends to flow to low position.

Therefore, angle for usage of the airsoft gun is limited. When the muzzle of the airsoft gun is lowered or heightened, the liquid air 42 may be stayed at the outlet or the bottom of the gas cartridge 40. It causes the liquid air 42 to excess or too less output. It is dangerous and unstable for the airsoft gun.

The gasification system 4 includes a compressed gas cartridge 40, and a vaporization tube 41. One end of the vaporization tube 41 is exposed to the compressed gas cartridge 40, and the other end is extended into the compressed gas cartridge 40 near to the center therein, a balance point. Because the distance to the liquid air 42 is near the same in each angle of the compressed gas cartridge 40, the pressure of the gaseous air 43 is constant. Therefore, whatever the angle of the compressed gas cartridge 40 is, the supplied amount of the output compressed high pressure air is almost constant.

Figure 5B:
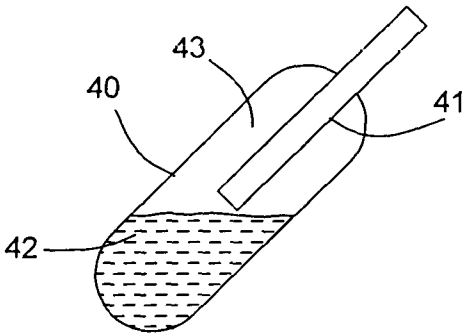
FIGS. 5A-5D are respective views of the gasification system in accordance with the present invention.
Figure 5D:
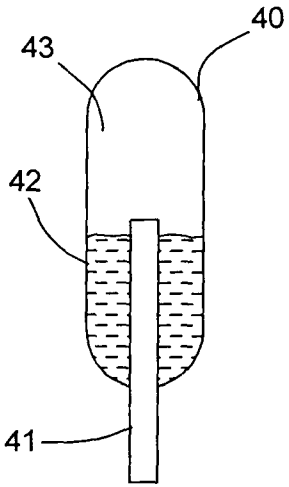
Figure 5A:
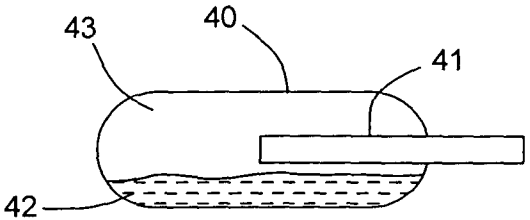
Figure 5C:
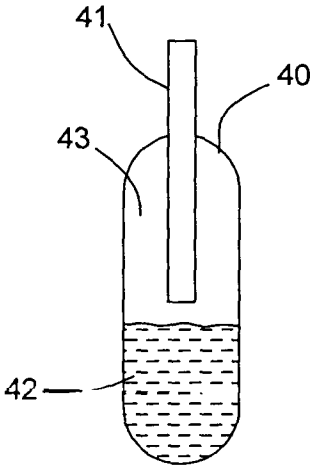

Please refer to FIGS. 5A-5D, the compressed gas cartridge 40 stays at 180 degrees, 45 degrees, 90 degrees, and 270 degrees, respectively. Without the vaporization tube 41, the output pressure may be too low as shown in FIGS. 5B-5C, due to the liquid air 42 is too far to the outlet. The liquid air 42 may be leaked directly without vaporization, as shown in FIG. 5D. By the vaporization tube 41 of this invention, the distance between the vaporization tube 41 to the liquid air 42 is near the same in each angle. The pressure of the gaseous air 43 is constant. The supplied amount of the output compressed high pressure air is almost constant. Especially is at 270 degrees shown in FIG. 5D, the vaporization tube 41 keeps the liquid air 42 without leaking. Hence, the security during operation is enhanced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An airsoft gun comprising an inner barrel and an outer barrel, the outer barrel has an air inlet and an air outlet, a back block, a front block and a hammer block are disposed between the inner barrel and the outer barrel, a hammer block spring is attached to an inner surface of the back block in the outer barrel, at the end of the hammer block spring on the opposite side to the back block, the hammer block is attached; wherein a compressed high pressure air is guided from the air inlet to move the hammer block, and the compressed high pressure air is released from the air outlet when the hammer block punches the back block, and the hammer block spring pushes the hammer block back to punch the front block to generate impact for simulating recoil motion after shooting.

2. The airsoft gun of claim 1, wherein an outer ring and an inner ring are disposed to the hammer block to make contact with the inner surface of the outer barrel and the outer surface of the inner barrel respectively to form a chamber within the outer barrel by the front block, the outer ring and the inner ring, the hammer block is moveable along the inner barrel between the front block and the back block, wherein the hammer block includes an inclined groove at the outer surface and the outer ring is disposed therein.

3. The airsoft gun of claim 1, further comprises a delay mechanism, the delay mechanism includes:

an air valve, being opened when the airsoft gun is triggered, to output the compressed high pressure air;

a pin, being moved down to be against the air valve to keep the air valve open;

a collapsing spring, being pushed by the hammer block during sliding toward the back block;

a relief lever, connected to the collapsing spring, wherein the relief lever lifts the pin when the collapsing spring is pushed; and a valve spring, connected to the air valve, wherein when the pin is lifted, the air valve is closed by the valve spring.

* * * * *